United States Patent [19]

Navone

[11] 4,089,601

[45] May 16, 1978

[54] DISPOSABLE TONER CARTRIDGE FOR COPYING MACHINES

[75] Inventor: Lorenzo Navone, Turin, Italy

[73] Assignee: Ing. C. Olivetti & C., S.p.A., Ivrea, Italy

[21] Appl. No.: 767,786

[22] Filed: Feb. 11, 1977

[30] Foreign Application Priority Data

Feb. 16, 1976 Italy ..... 67342/76

[51] Int. Cl.[2] ..... G03G 15/00; B67D 5/64

[52] U.S. Cl. ..... 355/14; 222/DIG. 1; 222/171; 222/553; 355/3 DD

[58] Field of Search ..... 355/14, 3 DD; 118/7; 222/171, 169, 553, 52, 63, DIG. 1

[56] References Cited

U.S. PATENT DOCUMENTS

| | | | |
|---|---|---|---|
| 3,339,807 | 9/1967 | Eichorn | 222/171 |
| 3,356,248 | 12/1967 | Del Vecchio | 222/553 X |
| 3,501,065 | 3/1970 | Altmann et al. | 222/DIG. 1 |
| 3,898,956 | 8/1975 | Andrako | 118/7 X |
| 3,981,272 | 9/1976 | Smith et al. | 355/3 DD |
| 3,999,654 | 12/1976 | Pollack | 222/DIG. 1 |

OTHER PUBLICATIONS

"Toner Dispenser" by R. A. Daniels, *IBM Tech. Bull.*, vol. 17, No. 4, Sept. 1974, pp. 1094, 1095.

*Primary Examiner*—Richard L. Moses
*Attorney, Agent, or Firm*—W. R. Hulbert

[57] ABSTRACT

Disposable toner cartridge for copying machine which has an outer casing with a first opening, and a container mounted within the casing and provided with a second opening. The container is movable between a position of containment of the toner, in which it is maintained during shipment, and a position of discharge, in which it is turned upon positioning of the cartridge in the copying machine and in which the first and second openings are aligned for discharging therethrough the toner into the copying machine. The casing is provided with clamping elements for clamping the container in the discharge position to prevent any subsequent movement of the container starting from the discharge position, so avoiding the re-use of the cartridge.

3 Claims, 7 Drawing Figures

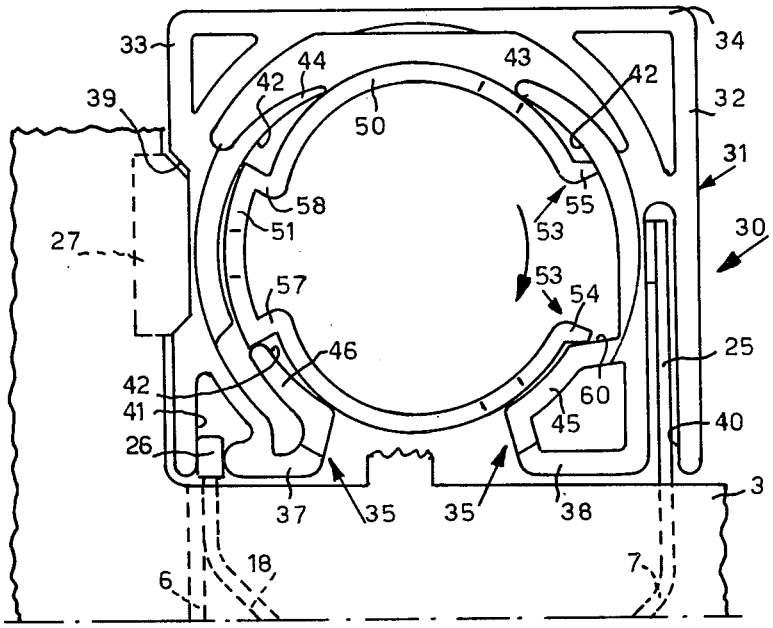
FIG. 3
FIG. 4
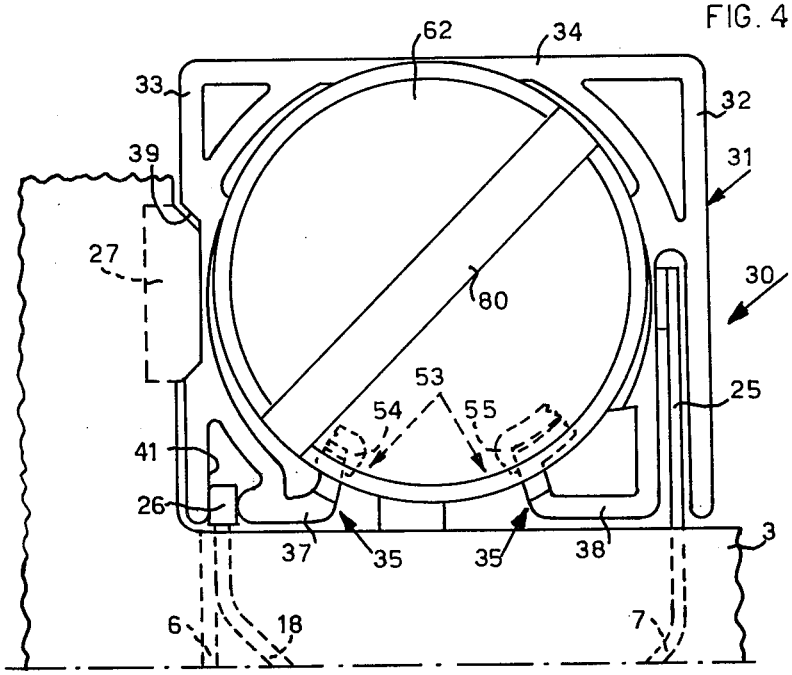

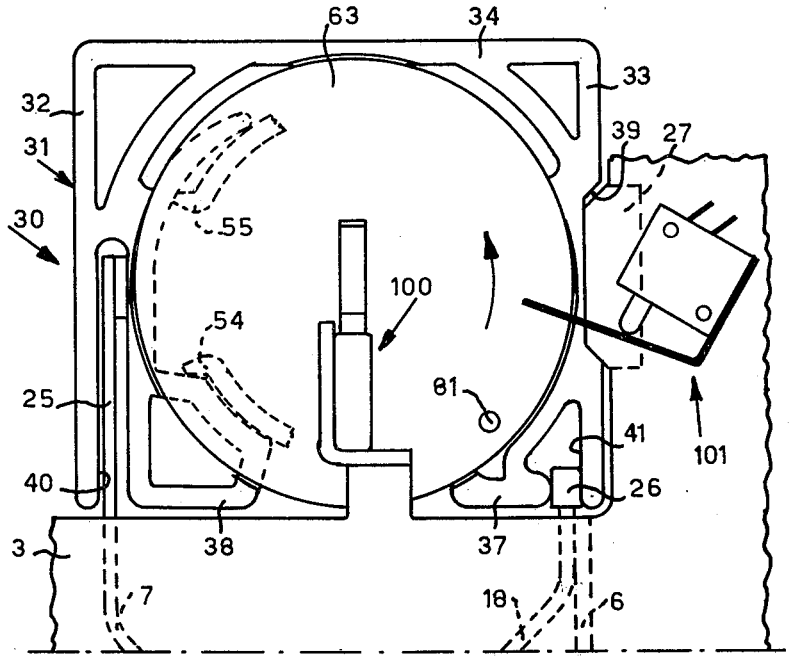
FIG. 5
FIG. 6
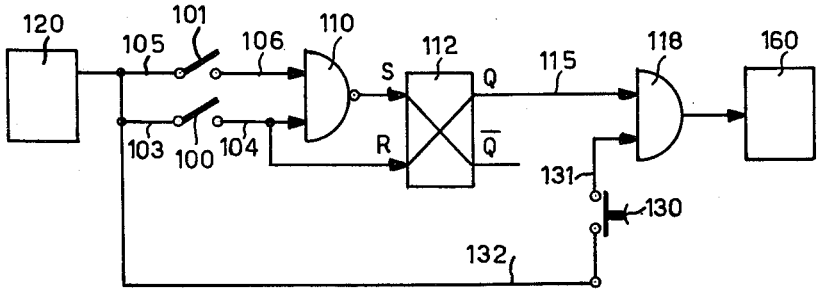

DISPOSABLE TONER CARTRIDGE FOR COPYING MACHINES

BACKGROUND OF THE INVENTION

The present invention relates to a cartridge for supplying the developing powder in an electrophotographic copying machine. More particularly, the invention relates to a disposable cartridge, that is of the type which is mounted removably in the machine and must be replaced when the supply of developing powder contained therein is exhausted.

The invention also relates to a copying machine including the cartridge.

A problem which arises with the disposable type of cartridge is that of preventing its reuse when it is exhausted by the user refilling it with developing powder of a type different from that specified for the machine and therefore not having suitable characteristics in many cases, with consequent disadvantages such as a decline in the quality of the copies obtained and the incorrect functioning of the developing unit, with possible damage to the machine.

SUMMARY OF THE INVENTION

One object of the present invention is to provide a disposable cartridge which cannot be reused when the supply of developing powder contained therein is exhausted.

According to the present invention, there is provided a cartridge for supplying the developing powder in a copying machine, comprising a first, outer, container having a first opening, a second container for the developing powder inside the first container and having a second opening and movable with respect to the first container from a position of containment of the developing powder to a position for discharge of the developing powder, in which the first and second openings are aligned and means arranged to prevent any subsequent movement of the second container with respect to the first container from the discharge position.

BRIEF DESCRIPTION OF THE DRAWINGS

The invention will be described in more detail, by way of example, with reference to the accompanying drawings, in which:

FIG. 3 is a front view of the container without its cover and in its inoperative state;

FIG. 4 is a front view, with cover, of the container in its operative state;

FIG. 5 is a rear view of the container as positioned in FIG. 3;

FIG. 6 shows a control circuit for the insertion of the container; and

DESCRIPTION OF THE PREFERRED EMBODIMENT

Figure 1:
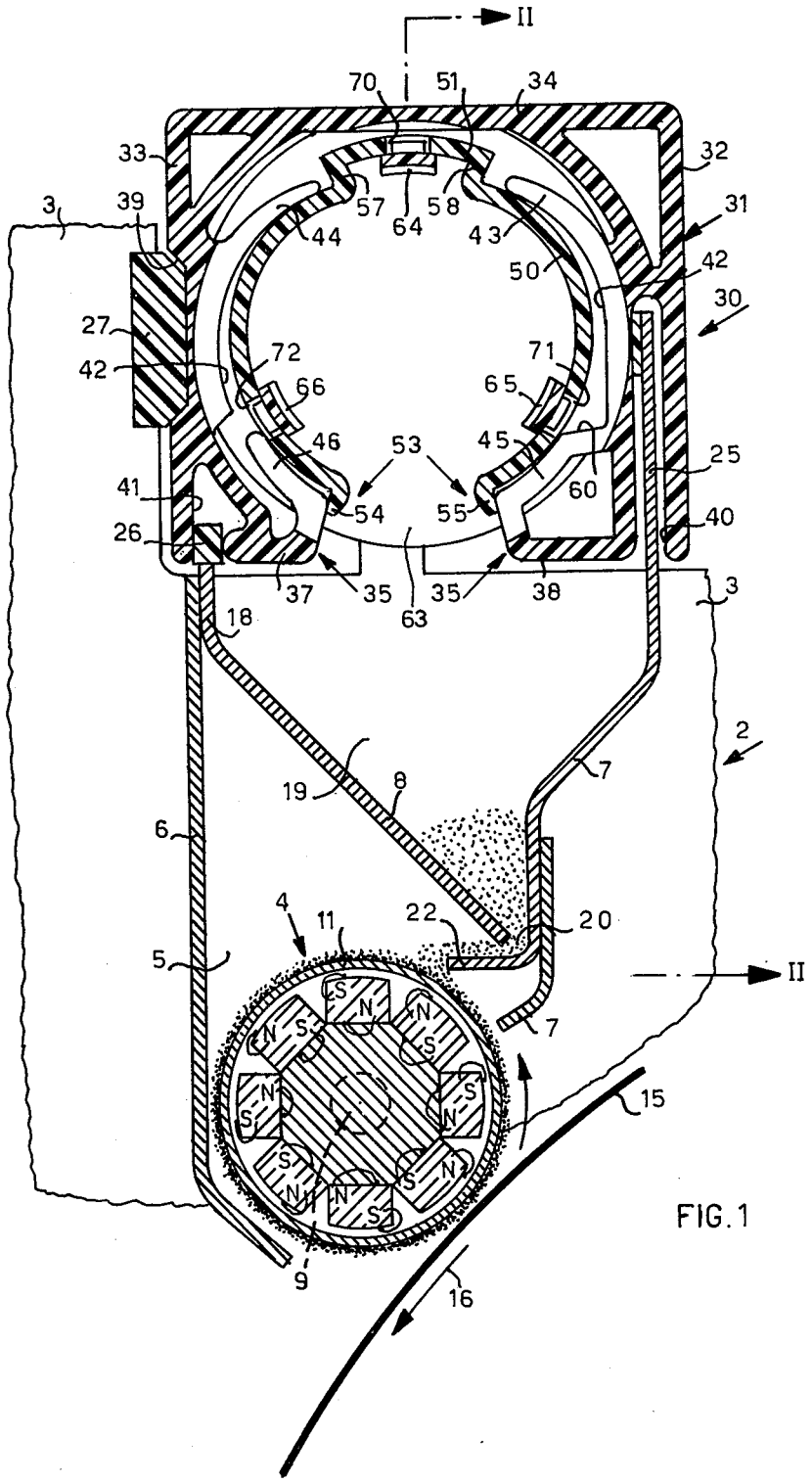
FIG. 1 is a front view in section of a container embodying the invention positioned in a copying machine.

FIG. 1 shows the developing unit 2 of an electrophotographic copying machine, comprising a magnetic brush device 4 of known type housed in a developing compartment 5 defined laterally by walls 6 and 7 and at the top by an inclined wall 8.

The magnetic brush device 4 is keyed on a pin 9 mounted rotatably on the frame 3 of the machine and is rotatable inside a hollow cylinder 11 of non-magnetic material fixed to the machine. The hollow cylinder 11 is mounted adjacent a photoconductive developing element 15 which is advanced in the direction of the arrow 16 by means not shown in the drawing.

Above the developing compartment 5 there is provided a hopper 19 for containing and metering the developing powder, the hopper being formed by the walls 7 and 8.

At the lowest point of the wall 8, a gap 20 between this wall and the wall 7 allows the developing powder contained in the hopper 19 to feed on to a lip 22 integral with the wall 7 and from which the powder drops on to the cylinder 11.

A cartridge 30 is mounted removably above the hopper 19 on guides 25, 26, 27 integral or fast with the wall 7, a top part 18 of the wall 8 and the frame 3 of the machine, respectively.

The cartridge 30 comprises an outer casing 31 with side walls 32 and 33 and a top wall 34 and provided at the bottom with an opening 35 defined by walls 37 and 38. In the walls 33, 37 and 38 there are provided grooves or slots 39, 41 and 40, respectively, adapted to co-operate with the guide 27, 26, 25 for mounting the cartridge 30 removably in the machine.

Inside the casing 31 there are provided ribs or tongues 43, 44, 45 and 46 solid with the walls 32, 33, 38 and 37 and disposed so as to define and delimit a substantially cylindrical cavity 42 of substantially elliptical cross-section having its axes parallel to the length of the casing. The rib 45 is provided with a step 60. The casing 31 can be made in one piece by extrusion of plastics material, such as, for example, ABS, and the thickness of the ribs 43, 44, 45 and 46 is such that they possess a certain elasticity.

Inside the cavity 42 there is mounted a cylindrical container 50 for the developing powder having its axis parallel to the axes of the cavity 42 and of substantially circular cross-section, but with a radial protuberance 51 defined by corners 57 and 58. The cylindrical container 50 is provided with an opening 53 extending parallel to its axis and substantially diametrically opposite the protuberance 51.

At the sides of the opening, two teeth 54 and 55 are provided. The cylindrical container 50 may be made by extrusion or moulding of plastics material, such as ABS, for example. The thickness of the cylindrical wall of the container 50 is such that the wall is endowed with a certain elasticity at least at the sides of the opening 53.

The cylindrical container 50 and the entire cartridge 30 are closed at the opposite ends by covers 62 and 63 (FIGS. 1 and 2) having resilient tongues 64, 65, 66 provided with teeth 67 adapted to engage in holes 70, 71, 72 provided in the cylindrical periphery of the container 50 (FIG. 1). The covers 62 and 63 are therefore fixed to the cylindrical container 50, but bear against the outer casing 31 and, therefore, once the covers 62 and 63 have been fixed, the container 50 can no longer be withdrawn from the cavity 42, nor are the covers removable except by breaking the teeth 67.

The cover 62 is provided with a grip 80 (FIG. 4). With the cartridge inserted in the machine, the cover 63 co-operates with a microswitch 100 (FIG. 2) which is therefore closed only when the cartridge is correctly positioned in the machine.

A pin 81 fast with the cover 63 (FIG. 5) is adapted to co-operate with a microswitch 101 when the grip 80 and, therefore, the cylindrical container 50 and the cover 63 which are fast with the grip are rotated in the direction indicated by the arrow from the position shown in FIGS. 5 and 3, as will be described hereinafter. The relative position between the microswitch 101 and the pin 81 is such that the microswitch is open at the beginning and at the end of the said rotation and is closed only during a given portion thereof.

FIG. 6 shows the connection of the microswitches 100 and 101 to the circuit of the copying machine. The microswitch 100 has a lead 103 connected to a voltage source 120 and a lead 104 connected as input to a NAND gate 110 and to the reset terminal of as RS flip-flop 112 of known type.

The microswitch 101 has a lead 105 connected to the voltage source 120 and a lead 106 connected as input to the NAND gate 110. The output of the NAND gate is connected to the set input of the flip-flop 112. The output Q of the flip-flop 112 is connected as input on a lead 115 to an AND gate 118, the output of which is connected to a unit 160 controlling and driving the machine. A start key 130 for the copying cycle of the machine has a lead 131 connected as input to the AND gate 118 and a lead 132 connected to the voltage source 120.

The closing of the key 130 puts an electric signal at logical 1 level on the lead 131. The closing of the microswitch 100 puts an electric signal at logical 1 level on the lead 104. The closing of the microswitch 101 puts an electric signal at logical 1 level on the lead 106.

A fresh cartridge 30 which is still to be used has its container 50 filled with developing powder and positioned with respect to the cavity 42 of the casing 31 as indicated in FIG. 3, with the cover 63 in the position of FIG. 5. In this position, the opening 53 is not aligned with the opening 35, but is at about 90° with respect to the latter and is closed by the inner faces of the ribs 43 and 45; the tooth 54 engages resiliently with the step 60 of the rib 45, while the tooth 55 is in frictional engagement with the cylindrical surface of the rib 43; both the teeth 54 and 55 therefore ensure sealing, preventing the developing powder from issuing from the cylindrical container 50.

The co-operation of the corner 57 with the end of the rib 46 and of the tooth 54 with the step 60 moreover prevent accidental rotation of the cylindrical container 50 during transport or meddling with the cartridge 30 before insertion thereof in the machine.

Once a fresh cartridge 30 is positioned in the machine, in order to render the machine operative and discharge the developing powder from the container 50 into the subjacent hopper chamber 19, it is necessary, as hereinbefore described, to rotate the grip 80, and consequently the container 50 and the cover 63 which are fast therewith, through 90° in the direction indicated by the arrow in FIGS. 3 and 5. Inter alia, this direction of rotation is obligatory since rotation of the container in the opposite direction is opposed by the jamming of the corner 57 against the end of the rib 46.

The rotation through 90° is permitted by the resilient nature of the ribs 43, 44, 45, 46 and of the cylindrical wall of the container 50 which, inter alia, enables the tooth 54 to disengage itself from the step 60.

Figure 2:
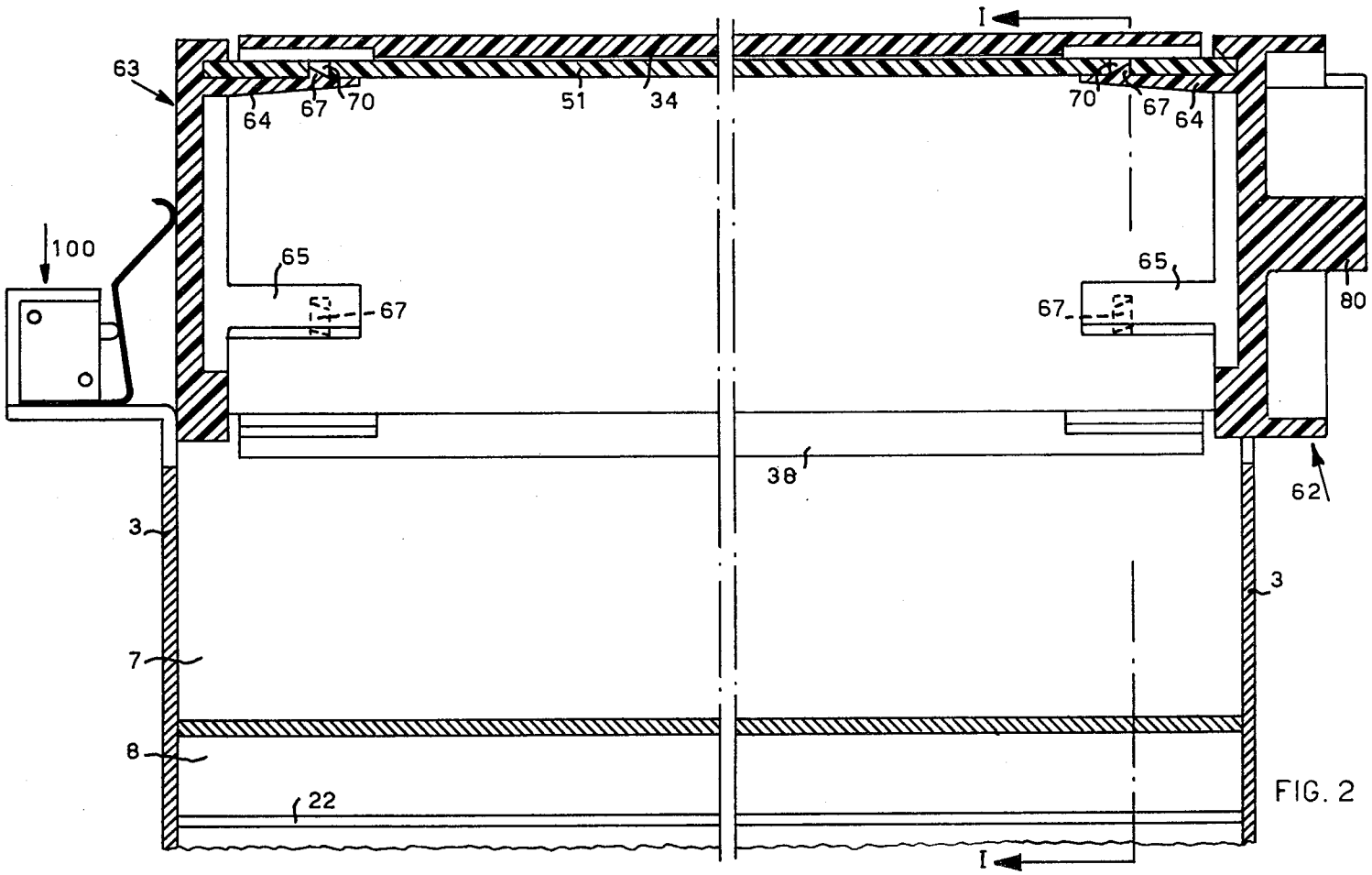
FIG. 2 is a partial section on the line II—II of FIG. 1.

At the end of the rotation through 90°, the position of the container 50 is that shown in FIGS. 1, 2 and 4, with the opening 53 aligned with the opening 35 and the protuberance 51 restrained between the ends of the ribs 43 and 44 which co-operate with the corners 58 and 57, respectively, of the protuberance 51. The developing powder drops through the aligned openings 35 and 53 into the hopper 19, whence, at each copying cycle that is executed, small quantities of the powder will be attracted in known manner by the magnetic brush 9 onto the surface of the hollow cylinder 11 and transported by the rotation of the latter to a position adjacent the photoconductive element 15, where the powder is attracted by the zones charge electrostatically in image configuration.

Any further rotation of the cylindrical container 50 from the position of FIG. 1 is prevented by the jamming or wedging of the corners 57 and 58 of the protuberance 51 against the ends of the ribs 43 and 44.

During the insertion of a fresh cartridge 30 and the rotation of the grip 80, the behaviour of the electric circuit of FIG. 6 is as follows. On insertion of a fresh cartridge 30, the microswitch 100 is closed by the cover 63, so that a signal at logical 1 level is present on the lead 104. The flip-flop is reset by the 0 to 1 transistor of this signal.

When the grip 80 is rotated through 90° in order to discharge the developing powder into the developing unit 2, the microswitch 101 is temporarily closed by means of the pin 81 and temporarily brings a signal to logical 1 level on the wire 106, whereby the output of the NAND gate 110, which has both its inputs at 1, is put at logical 0 level. The reversion of the NAND gate output to 1 level causes the setting of the flip-flop 112, the output Q of which is put at logical 1 level. The logical level on the lead 115 therefore becomes 1 and this enables the AND gate 118, so that every time the START key 130 is pressed, a logical 1 level signal will be applied to the control and driving unit 160 of the machine which, in response, will provide for the execution of a copying cycle. It is to be noted that at the end of the rotation of the grip 80 the mircoswitch 101 is again open and the logical level on the wire 106 is therefore 0.

When, the developing powder being exhausted, the cartridge 30 is withdrawn in order to replace it (correctly) by a fresh one or to attempt to recharge the old one (incorrectly), the microswitch 100 is opened and a signal at logical 0 level is put on the wire 104, causing the resetting of the flip-flop 112 ($Q = 0$, $\overline{Q} = 1$), whereby the logical signal on the wire 115 returns to 0, inhibiting the AND gate 118 and therefore also the START key 130.

From what has been described above it is clear that there is a double protection against the insertion of an already used cartridge 30 in the machine:

A first protection which is purely mechanical and inside the cartridge 30 itself, due to the impossibility of rotating the container 50 in a used cartridge from the position of FIGS. 1, 2 and 4, which prevents in practice the recharging of the container with other developing powder, since the two slots or openings 35 and 53 are aligned and the powder would escape completely through them during the positioning of the cartridge in the machine with the openings facing downwardly;

And a second protection again linked with the impossibility of rotating the grip 80 and the cover 63 from the position of FIGS. 1, 2 and 4, but of an electrical nature, inasmuch as this lack of rotation prevents the closing of the microswitch 101 and therefore prevents the enabling of the START key and, in short, of the machine for use. Thus mere insertion of cartridge resets the flip-flop 112 which can only be set again by closing and opening the switch 101, by rotating the container 50.

Other electric circuits can be devised to perform the same function and the electric circuit can be replaced by a mechanical device which performs the same function, that is it prevents the activation of the START key if a cartridge 30 has not been inserted in the machine and if the grip of the cartridge is not rotated as hereinbefore described.

Figure 7:
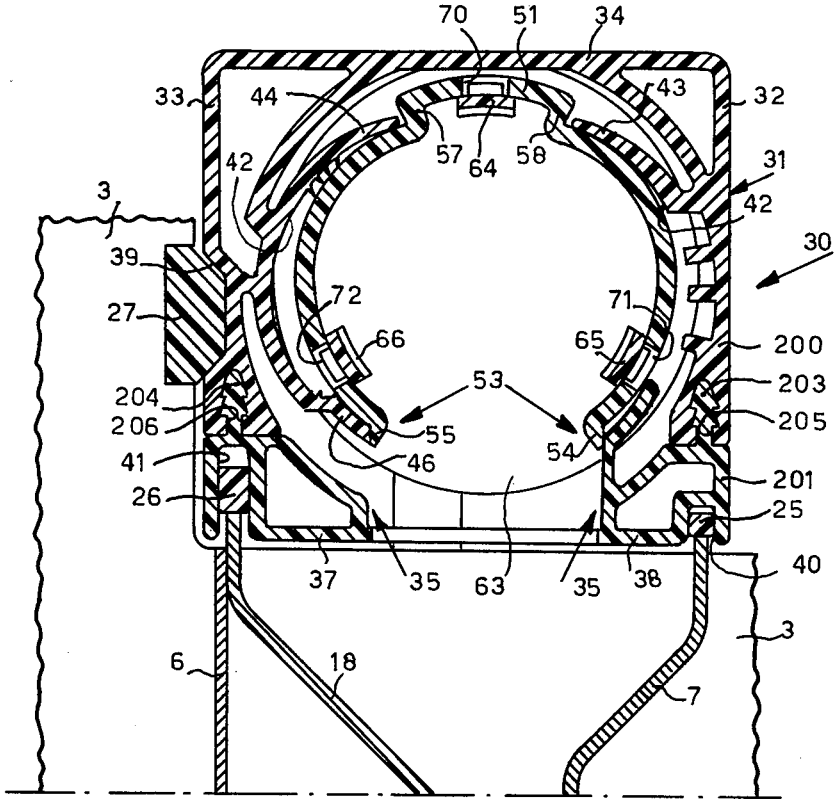
FIG. 7 is a front view, in section, of a modified container embodying the invention.

FIG. 7 shows a modification of the outer casing 31 which, for simplicity of construction, is constituted by two parts 200 and 201, each obtained by extrusion of plastics material such as, for example, ABS and each provided with fixed resilient elements 203, 204 and 205 and 206, respectively, adapted to be coupled together irreversibly to form the casing 31.

What I claim is:

1. A cartridge for containing and supplying developing powder in a copying machine, comprising:

a casing having a first opening;

a container for the developing powder mounted inside said casing, having a second opening and movable with respect to said casing from a position of containment of the developing powder to a position of discharge of the developing powder, in which the first and second openings are aligned and the developing powder is discharged through said opening; and, means for clamping said container in said second discharge position to prevent any subsequent movement of the container with respect to the casing starting from the discharge position.

2. In a copying machine of the electrophotographic type, the combination comprising:

a cartridge for containing and supplying developing powder into the copying machine including:

a casing having a first opening, a container for the developing powder mounted inside said casing, having a second opening and movable with respect to said casing from a position of containment of the developing powder to a position of discharge of the developing powder, in which the first and second openings are aligned and the powder is discharged through said openings, and means for clamping said container in said discharge position to prevent any subsequent movement of the container with respect to the casing, starting from the discharge position;

means removably mounting said cartridge in the copying machine;

first detecting means for detecting the movement of the container from the containment position to the discharge position; and enabling means, responsive to said first detecting means upon detection of said movement from the containment position to the discharge position, for enabling the copy operation of the machine.

3. In a copying machine according to claim 2 further comprising:

second detecting means for detecting the correct positioning of the cartridge on said removably mounting means, said enabling means being also responsive to said second detecting means upon detection thereof, whereby the machine is enabled only when the cartridge is correctly positioned in the copying machine and the container has been moved in said discharge position.

* * * * *